US012369760B2

(12) United States Patent
Wu

(10) Patent No.: US 12,369,760 B2
(45) Date of Patent: Jul. 29, 2025

(54) HINGE CONNECTION FOR TOILET LID AND SEAT

(71) Applicant: Topseat International, Inc., Plano, TX (US)

(72) Inventor: Chengdong Wu, Allen, TX (US)

(73) Assignee: Topseat International, Inc., Plano, TX (US)

( * ) Notice: Subject to any disclaimer, the term of this patent is extended or adjusted under 35 U.S.C. 154(b) by 161 days.

(21) Appl. No.: 18/313,478

(22) Filed: May 8, 2023

(65) Prior Publication Data

US 2024/0277191 A1 Aug. 22, 2024

Related U.S. Application Data

(60) Provisional application No. 63/485,750, filed on Feb. 17, 2023.

(51) Int. Cl.
*A47K 13/12* (2006.01)

(52) U.S. Cl.
CPC ..... *A47K 13/12* (2013.01)

(58) Field of Classification Search
CPC ..... A47K 13/12; A47K 13/26
See application file for complete search history.

(56) References Cited

U.S. PATENT DOCUMENTS 1,290,611 A * 1/1919 Lussier ..... A47K 13/00 4/234
1,352,058 A * 9/1920 Frothingham ..... A47K 13/26 4/240
1,408,991 A * 3/1922 Dobson ..... A47K 13/26 4/240
4,173,802 A * 11/1979 Wikstrom ..... A47K 13/12 4/240
2024/0140870 A1* 5/2024 Outhwaite ..... C04B 28/021

FOREIGN PATENT DOCUMENTS

CN 214284718 U 9/2021

OTHER PUBLICATIONS

International Search Report and Written Opinion of the International Searching Authority dated Aug. 10, 2023, in connection with International Application No. PCT/US2023/021305, 9 pages.

* cited by examiner

*Primary Examiner* — Christine J Skubinna

(57) ABSTRACT

A system includes a toilet seat, a toilet lid comprising a core structural layer and a second layer, and at least one hinge assembly pivotally coupling the toilet seat and toilet lid. Each of the at least one hinge assembly includes a hinge portion in contact with an exterior surface of the second layer. Each of the at least one hinge assembly also includes a hinge connection plate in contact with an interior surface of the second layer, the hinge connection plate having multiple first fastener holes, each first fastener hole having a protrusion.

20 Claims, 9 Drawing Sheets

HINGE CONNECTION FOR TOILET LID AND SEAT

CROSS-REFERENCE TO RELATED APPLICATION AND PRIORITY CLAIM

This application claims priority under 35 U.S.C. § 119(e) to U.S. Provisional Patent Application No. 63/485,750 filed on Feb. 17, 2023, which is hereby incorporated by reference in its entirety.

TECHNICAL FIELD

This disclosure is generally directed to toilet equipment and more particularly to a hinge connection for a toilet lid and seat.

BACKGROUND

For toilet seats and lids currently available on the market, various types of materials are commonly used to make up the main part of the toilet seats and lids. One type is wood materials such as molded wood and fiber boards, among which medium density fiber boards (MDF) plays a prominent role. Another type is thermoplastic materials such as urea formaldehyde (duroplast) and polypropylene (PP). Still another type includes sintered stone.

SUMMARY

This disclosure provides a hinge connection for use in a hinge assembly of a toilet lid and seat.

In a first embodiment, a system includes a toilet seat, a toilet lid comprising a core structural layer and a second layer, and at least one hinge assembly pivotally coupling the toilet seat and toilet lid. Each of the at least one hinge assembly includes a hinge portion in contact with an exterior surface of the second layer. Each of the at least one hinge assembly also includes a hinge connection plate in contact with an interior surface of the second layer, the hinge connection plate having multiple first fastener holes, each first fastener hole having a protrusion In a second embodiment, a toilet seat assembly includes a toilet seat, a toilet lid comprising a core structural layer and a second layer, and multiple hinge assemblies pivotally coupling the toilet seat and toilet lid. Each hinge assembly includes a hinge portion having a flat surface in contact with an exterior surface of the second layer. Each hinge assembly also includes a hinge connection plate in contact with an interior surface of the second layer, the hinge connection plate having multiple first fastener holes, each first fastener hole having a protrusion. Each hinge assembly further includes multiple fasteners connecting the hinge portion and the hinge connection plate.

Other technical features may be readily apparent to one skilled in the art from the following figures, descriptions and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

The figures described below and the various embodiments used to describe the principles of the present disclosure in this patent document are by way of illustration only and should not be construed in any way to limit the scope of the disclosure. Those skilled in the art will understand that the principles of the present disclosure may be implemented in any type of suitably arranged device or system.

Some materials used to form toilet lids and toilet seats, such as sintered stone, are strong, but can be brittle and are subject to fracture in the presence of acute stress forces. For example, in locations where fasteners are placed through holes to couple a toilet lid or toilet seat to a hinge assembly, the large tensile or torsional forces resulting from movement of the hinge assembly can cause splintering or fracturing of the toilet lid or toilet seat. To avoid such fracturing, holes and fasteners can be formed in small dimensions, however, such small fasteners may not provide a strong connection between parts.

To address these and other issues, embodiments of this disclosure provide one or more hinge connections that provide a strong bond and prevent (or reduce the likelihood of) a fracture of the toilet lid, the toilet seat, or both. This reduces the likelihood of a hinge assembly separating from the toilet lid, the toilet seat, or both.

It will be understood that embodiments of this disclosure may include any one, more than one, or all of the features described here. In addition, embodiments of this disclosure may additionally or alternatively include other features not listed here. Although the disclosed embodiments are described with respect to a toilet seat and lid, such description is not limiting since the disclosed embodiments are suitable for a wide range of applications.

Figure 1:
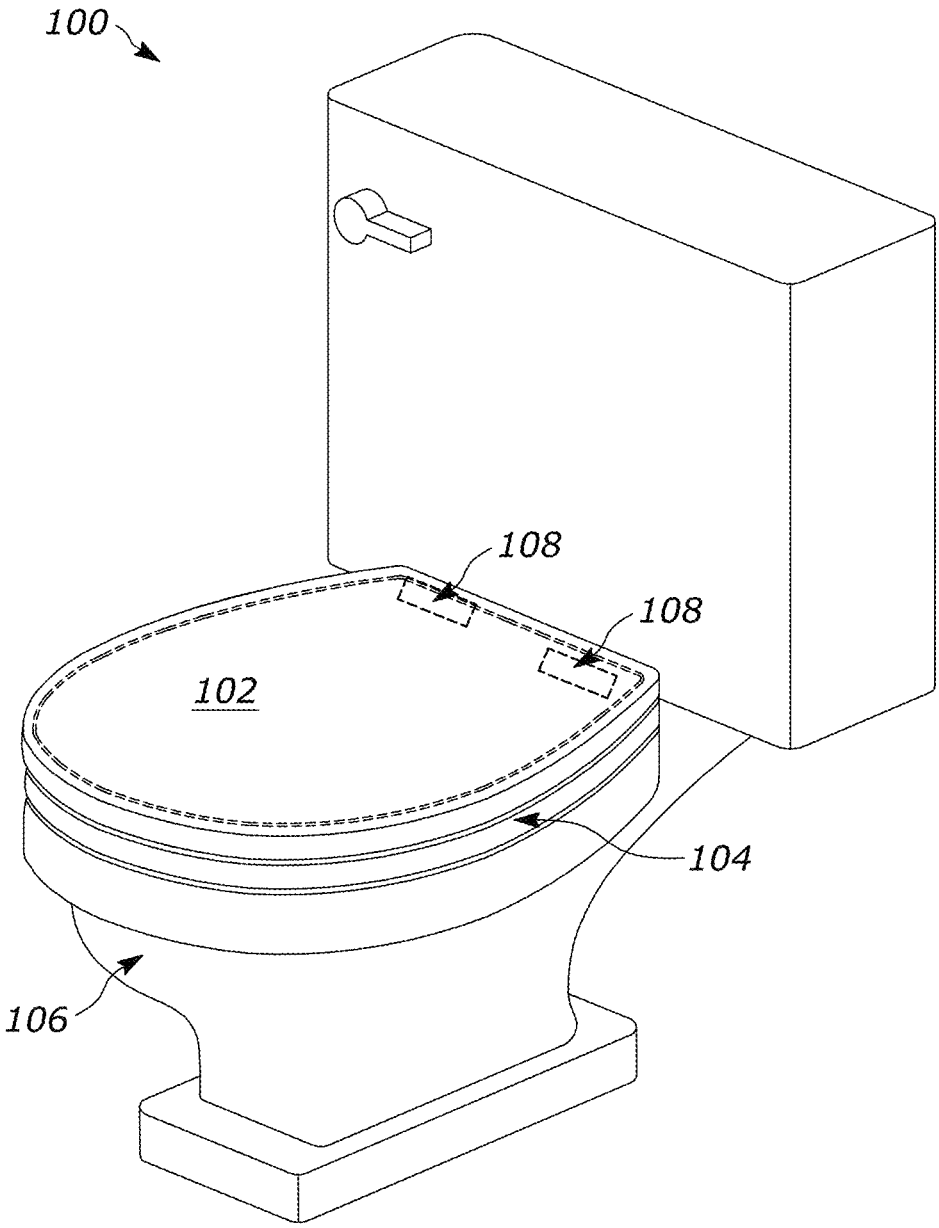
FIG. 1 illustrates a toilet with a toilet lid and seat on which a hinge connection can be employed, according to embodiments of the present disclosure.

FIG. 1 illustrates a toilet with a toilet lid and seat on which a hinge connection can be employed, according to embodiments of the present disclosure. The embodiment of the toilet 100 shown in FIG. 1 is for illustration only. Other embodiments of the toilet 100 could be used without departing from the scope of this disclosure. Those skilled in the art will recognize that, for simplicity and clarity, some features and components are not explicitly shown in every figure, including those illustrated in connection with other figures. Such features, including those illustrated in other figures, will be understood to be equally applicable to the toilet 100. It will be understood that all features illustrated in the figures may be employed in any of the embodiments described. Omission of a feature or component from a particular figure is for purposes of simplicity and clarity, and not meant to imply that the feature or component cannot be employed in the embodiments described in connection with that figure.

As shown in FIG. 1, the toilet 100 is fitted with a toilet lid 102 and toilet seat 104 over a bowl 106. The toilet 100 may be any suitable toilet with a bowl that is configured to be covered by a seat and lid. The bowl 106 has an opening that is generally round or oval in shape. The toilet lid 102 and toilet seat 104 have a size and shape configured to generally match the size and shape of the bowl 106 and to cover the opening of the bowl 106. The toilet lid 102 and toilet seat 104 are pivotally coupled to each other and secured to a rear portion of the bowl 106 or toilet 100 using a pair of hinge assemblies 108 that allow the toilet lid 102 and toilet seat 104 to raise and lower independently with respect to the bowl 106 and to each other. The hinge assemblies 108 are secured to a flange portion at the rear of the bowl 106. The hinge assemblies 108 can be configured for easy installation and removal of the toilet lid 102, toilet seat 104, or both. Further details regarding the hinge assemblies 108 are provided below.

Although FIG. 1 depicts one example of a toilet 100 with a toilet lid 102 and toilet seat 104, various changes may be made to FIG. 1. For example, while the bowl 106 is depicted as generally round or oval in shape, the bowl 106 could include other shapes, such as a rectangle or octagon. Likewise, while FIG. 1 illustrates a general placement and arrangement for the hinge assemblies 108 with respect to the toilet 100, this is for illustration purposes only. The exact placement, shape, and quantity of the hinge assemblies 108 could vary depending on the embodiment.

Figure 2:
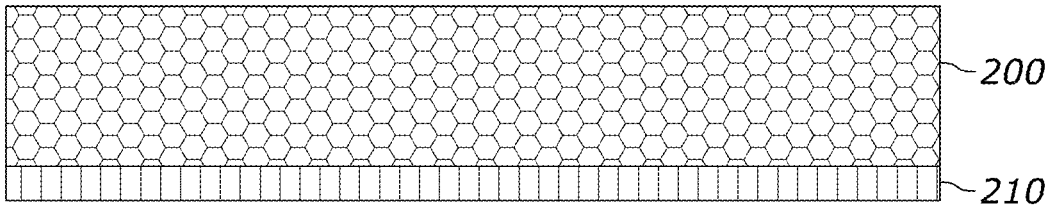
FIG. 2 illustrates a schematic cross-sectional view of a toilet lid or seat with a core structural layer comprising or substantially consisting of sintered stone, according to embodiments of the present disclosure.

FIG. 2 illustrates a schematic cross-sectional view of a toilet lid 102 according to embodiments of the disclosure. However, the described structure may also be used for a toilet seat 104 according to embodiments of the disclosure.

As shown, the toilet lid 102 is provided with a core structural layer 200 that comprises or substantially consists of sintered stone. While sintered stone has high compression strength, is hard, scratch resistant, chemical resistant, water resistant, and easy to clean, it is also more brittle when compared to other toilet lid materials. In order to increase the strength, toughness, and impact resistance of the toilet lid 102, it is preferable that a second layer 210 be provided on the lower surface of the core structural layer 200. Providing the second layer 210 on the lower surface contributes in particular to an increased tensile strength.

In a preferred embodiment, the second layer 210 may be a metal layer. Preferred materials for the metal layer are aluminum, or metal alloys such as aluminum alloy, magnesium alloy, and titanium alloy. The use of aluminum or these metal alloys is particularly advantageous as it provides an increase in overall strength, durability, and longevity of the toilet lid 102 comparable to the use of stainless steel. At the same time, aluminum and the aforementioned metal alloys are lighter than stainless steel and thus prevent the toilet lid 102 from becoming too heavy to be comfortably used.

As a particular example, the second layer 210 may comprise or substantially consist of a metal alloy, and may have a thickness between 0.5 to 2 mm. As another example, the second layer 210 may comprise or substantially consist of aluminum and may have a thickness of 0.2 to 1.0 mm. Additionally, the core structural layer 200 comprising or substantially consisting of sintered stone may have a thickness between 5 to 7 mm.

In another preferred embodiment, the second layer 210 comprises or substantially consists of fiber reinforced cement board or fiber reinforced calcium silicate board, and may additionally have a thickness between 5 to 8 mm. A coated or painted layer may be disposed on the lower surface of the second layer 210 to provide further protection to the second layer 210 against external influences. This may also serve to visibly mask the second layer 210, and further allows the provision of decorative effects. Additionally, the core structural layer 200 comprising or substantially consisting of sintered stone may have a thickness between 3 to 6 mm.

Figure 3:
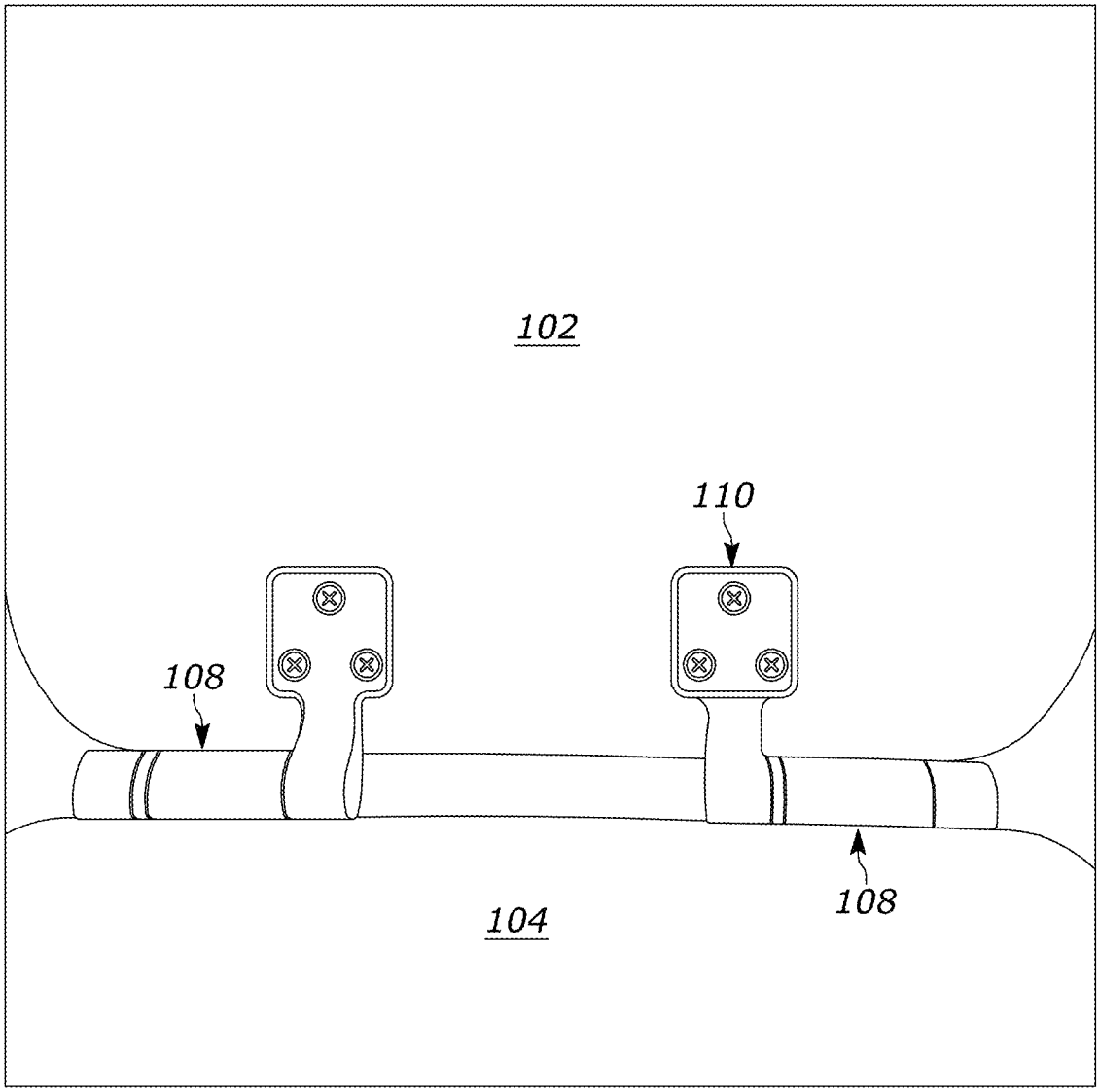
FIG. 3 illustrates additional details of a hinge assembly in which a hinge connection can be employed, according to embodiments of the present disclosure.

FIG. 3 illustrates additional details of the hinge assembly 108 according to embodiments of the present disclosure. As shown in FIG. 3, the toilet lid 102 and the toilet seat 104 are coupled using a pair of hinge assemblies 108. Portions of the hinge assembly 108 are attached to the toilet lid 102 using one or more fasteners 110. Portions of the hinge assembly 108 are attached to the toilet seat 104 using one or more other fasteners (not shown). As described in greater detail below, each hinge assembly 108 can include a hinge connection that prevents (or reduces the likelihood of) separation of the hinge assembly 108 from the toilet lid 102.

Figure 4:
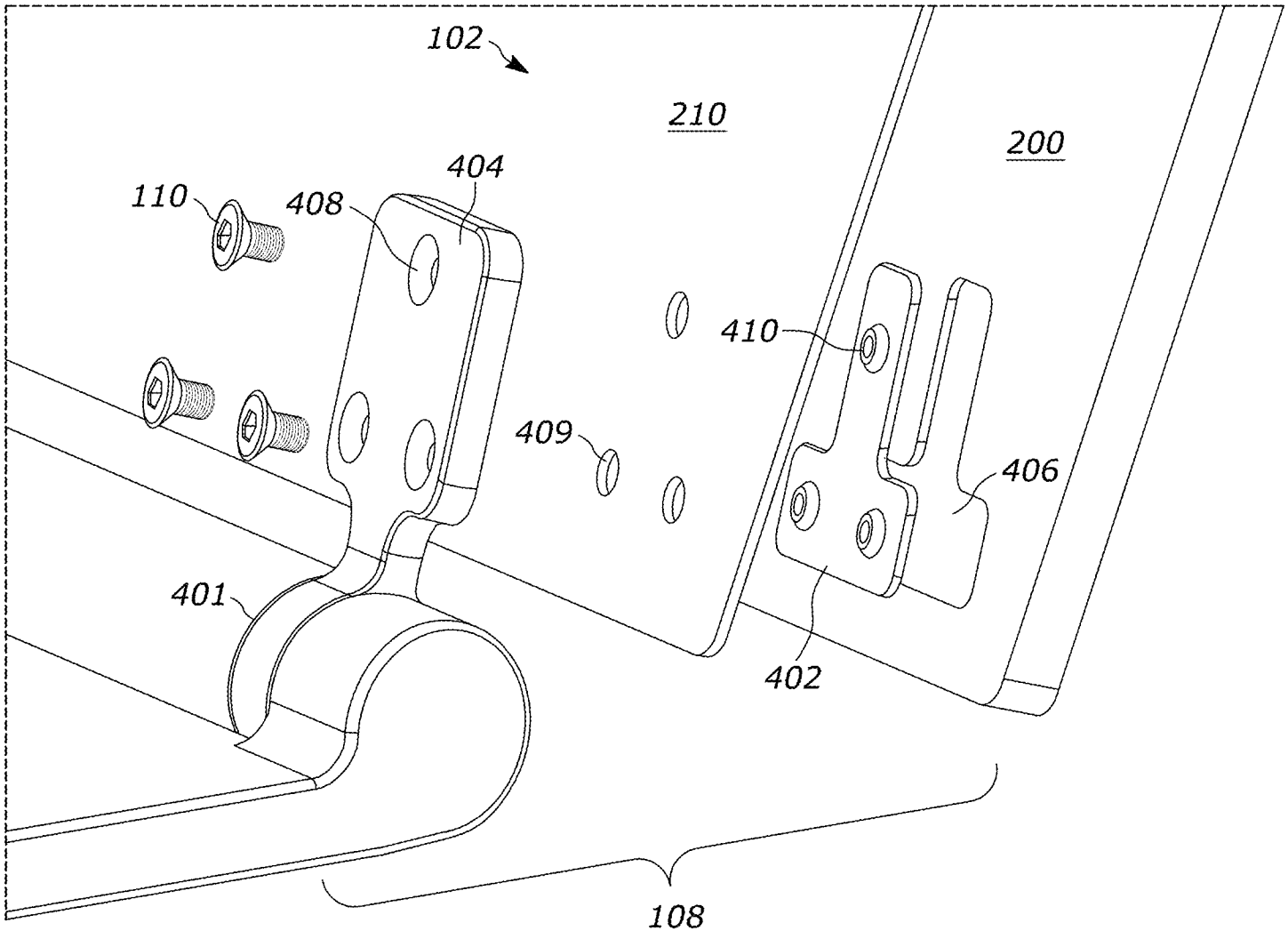
FIG. 4 illustrates additional details of portions of the hinge assembly according to embodiments of the present disclosure.

FIG. 4 illustrates additional details of portions of the hinge assembly 108 according to embodiments of the present disclosure. As shown in FIG. 4, the hinge assembly 108 is shown in an exploded view relative to the toilet lid 102. Here, the toilet lid 102 is formed as shown in FIG. 4, with a core structural layer 200 and a second layer 210. In some embodiments, the core structural layer 200 is formed of sintered stone, and the second layer 210 is formed of metal. The hinge assembly 108 includes a hinge portion 401 and a hinge connection plate 402. The hinge portion 401 includes a flat portion 404 with a flat back surface that, when assembled, is in contact with a flat exterior surface of the second layer 210. The hinge connection plate 402 is disposed adjacent another (interior) surface of the second layer 210 that is opposite the flat exterior surface. When assembled, the hinge connection plate 402 sits inside a recess 406 formed in the core structural layer 200. In some embodiments, the recess 406 has a shape and size that corresponds to the shape and size of the hinge connection plate 402.

The flat portion 404, the second layer 210, and the hinge connection plate 402 all have corresponding fastener holes 408-410 that are positioned to align with each other when the components of the hinge assembly 108 are assembled. That is, the fastener holes 408 of the flat portion 404 align with corresponding fastener holes 409 of the second layer 210 and also with corresponding fastener holes 410 of the hinge connection plate 402. The alignment of the fastener holes 408-410 allows the fasteners 110 to be placed through the flat portion 404, the second layer 210, and the hinge connection plate 402 for assembling the various components and securing the components together. While FIG. 4 shows three of each of the fastener holes 408-410, this is merely one example; the fastener holes 408-410 could be in other quantities and be arranged in other patterns.

Figure 5:
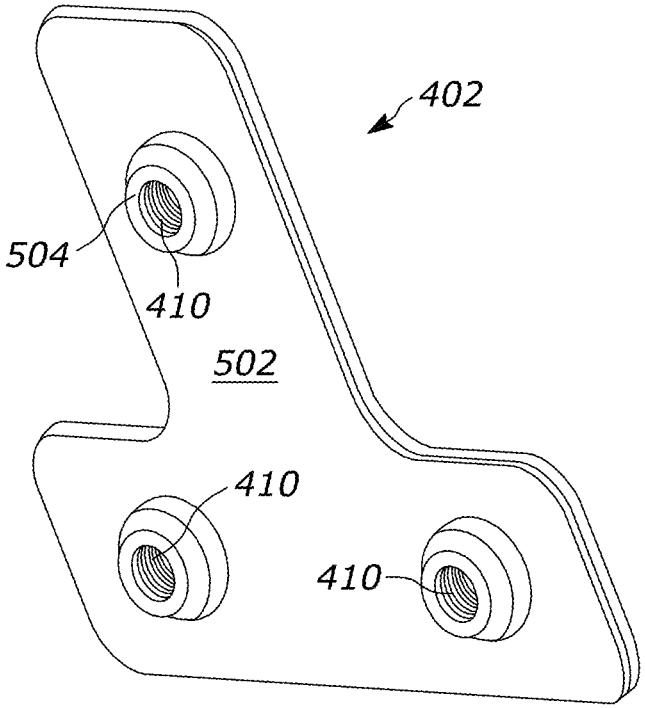
FIGS. 5 and 6 illustrate additional details of a hinge connection plate according to embodiments of the present disclosure.
Figure 6:
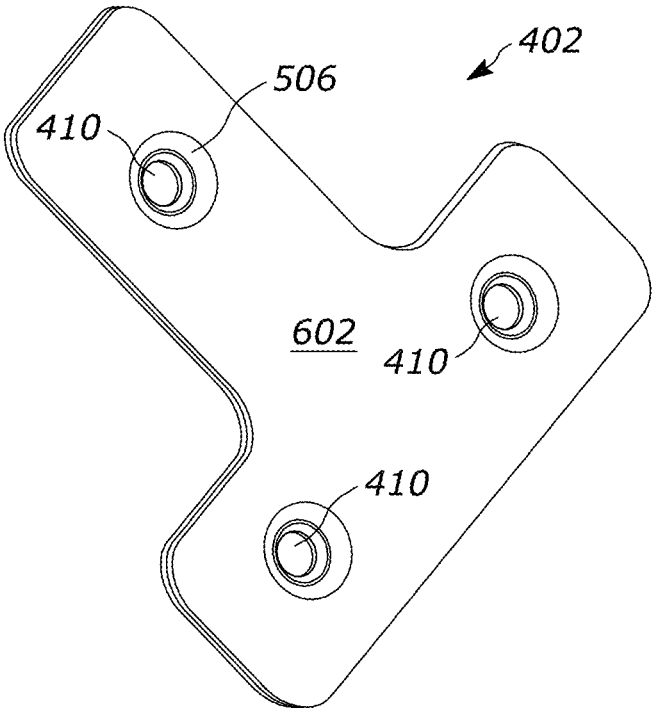

FIGS. 5 and 6 illustrate additional details of the hinge connection plate 402 according to embodiments of the present disclosure. In particular, FIG. 5 shows a first side 502 of the hinge connection plate 402, and FIG. 6 shown a second side 602 of the hinge connection plate 402 opposite the first side 502. As shown in FIGS. 5 and 6, the hinge connection plate 402 is a substantially flat plate, with substantially planar surfaces on both the first side 502 and the second side 602. Here, the hinge connection plate 402 is formed in the shape of a T. However, this is merely one example, and the hinge connection plate 402 could be formed in other shapes, such as a rectangle, a square, a circle, an H-shape, an L-shape, or any other suitable shape.

The fastener holes 410 are formed in multiple locations on the hinge connection plate 402 and extend completely through the hinge connection plate 402. Each of the fastener holes 410 includes a protrusion 504 such that the edge of each fastener hole 410 projects above the surface of the first side 502. In some embodiments, the inside surface of each fastener hole 410, including the inside surface of the protrusion 504, can include screw threads to accept a screw through the fastener hole 410. Each fastener hole 410 also includes a recess area 506 on the second side 602 of the hinge connection plate 402. The recess area 506 is wider in diameter than the fastener hole 410 and extends only partially within the fastener hole 410. In some embodiments, the recess area 506 is formed when the fastener hole 410 is punched in the hinge connection plate 402 from the second side 602.

Turning again to FIG. 4, the hinge connection plate 402 is configured to sit within the recess 406, with the second side 602 in contact with the bottom of the recess 406, and the first side 502 in contact with the back side of the second layer 210. The thickness of the hinge connection plate 402 is the same as (or slightly less than) the depth of the recess 406, such that the first side 502 of the hinge connection plate 402 does not extend beyond the planar interior surface of the core structural layer 200. The fastener holes 409 in the second layer 210 are slightly wider in diameter than the protrusions 504, such that the protrusions 504 can sit within the fastener holes 409. In some embodiments, the height of each protrusion 504 is approximately the same as the depth of the corresponding hole 409, which is also the thickness of the second layer 210 (e.g., approximately 1.2 mm, although other dimensions are possible).

Figure 7:
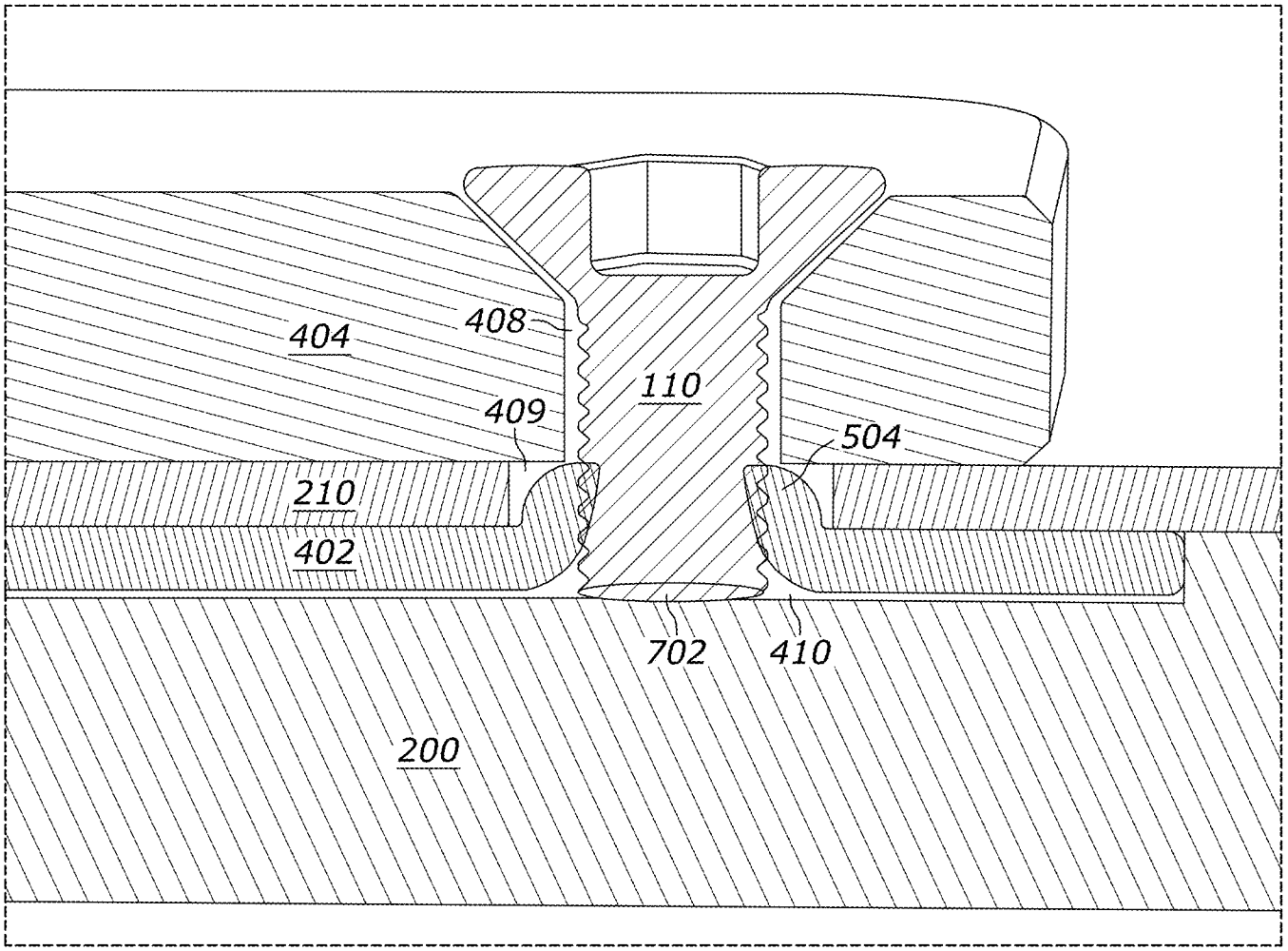
FIG. 7 illustrates the hinge assembly attached to the toilet lid according to embodiments of the present disclosure.

FIG. 7 illustrates a cross sectional view of the hinge assembly 108 attached to the toilet lid 102. When the hinge assembly 108 is assembled to the toilet lid 102, the hinge connection plate 402 is disposed within the recess 406, the protrusions 504 are disposed within the fastener holes 409, and the fastener holes 408 of the flat portion 404 are aligned with the fastener holes 409 and 410. A fastener 110 is extended through each set of fastener holes 408-410 to secure the components together. For example, the fastener 110 may be a screw, and the screw 110 passes through the fastener holes 408-410, with the head of the screw 110 aligned with the top surface of the flat portion 404 of the hinge portion 401. In some embodiments, each fastener hole 408 includes a countersink or counterbore to accept the head of the screw 110.

In some embodiments, the thickness of the hinge connection plate 402 from the first side 502 to the second side 602 is approximately 1.2 mm, and the height of each protrusion 504 is also approximately 1.2 mm. Thus, the overall depth of each hole 410 is approximately 2.4 mm. Accordingly, when the hinge assembly 108 is assembled, the shaft of the screw 110 can be advanced in the fastener hole 410 approximately 2.4 mm without any portion of the screw 110 extending into the core structural layer 200 beyond the depth of the recess 406. Conversely, if each hole 410 in the hinge connection plate 402 did not include a protrusion 504, then the overall depth of each hole 410 would be only approximately 1.2 mm, and would accommodate only approximately 1.2 mm of the shaft of the screw 110. Thus, the presence of the protrusions 504 provides a deeper hole 410 to accept a longer portion of the screw 110, which results in a stronger hinge connection for the hinge assembly 108.

In some embodiments, during assembly, an optional glue 702 or other liquid adhesive can be placed within the fastener hole 410 before the screw 110 is threaded into the fastener hole 410. The glue 702 can pool in the empty space around the recess area 506, and the screw 110 can advance into the liquid glue 702. Once the glue 702 dries, the dried glue also helps to hold the screw 110 in place, thereby creating an even stronger bond for the hinge assembly 108.

Although FIGS. 3 through 7 depict various details of one example of a hinge assembly 108, various changes may be made to FIGS. 3 through 7. For example, while shown comprised of certain components, the hinge assembly 108 may include more or fewer components. Components shown in FIGS. 3 through 7 may be removed, repeated, or arranged in a different order. Components may have dimensions other than those shown or described. Other components, composed of the same or different materials, may be added to the hinge assembly 108.

Figure 8:
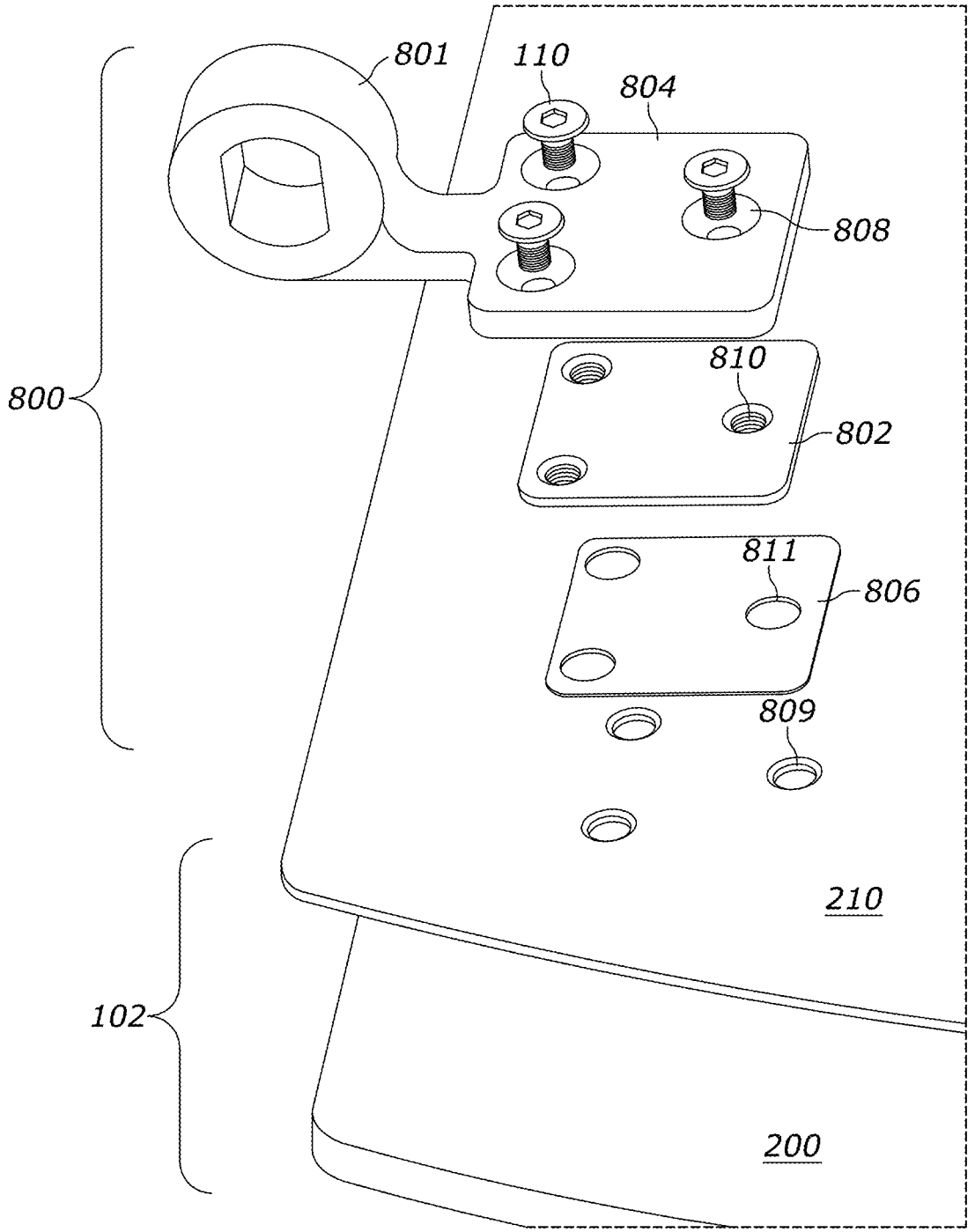
FIGS. 8 and 9 illustrate another example hinge assembly according to embodiments of the present disclosure.
Figure 9:
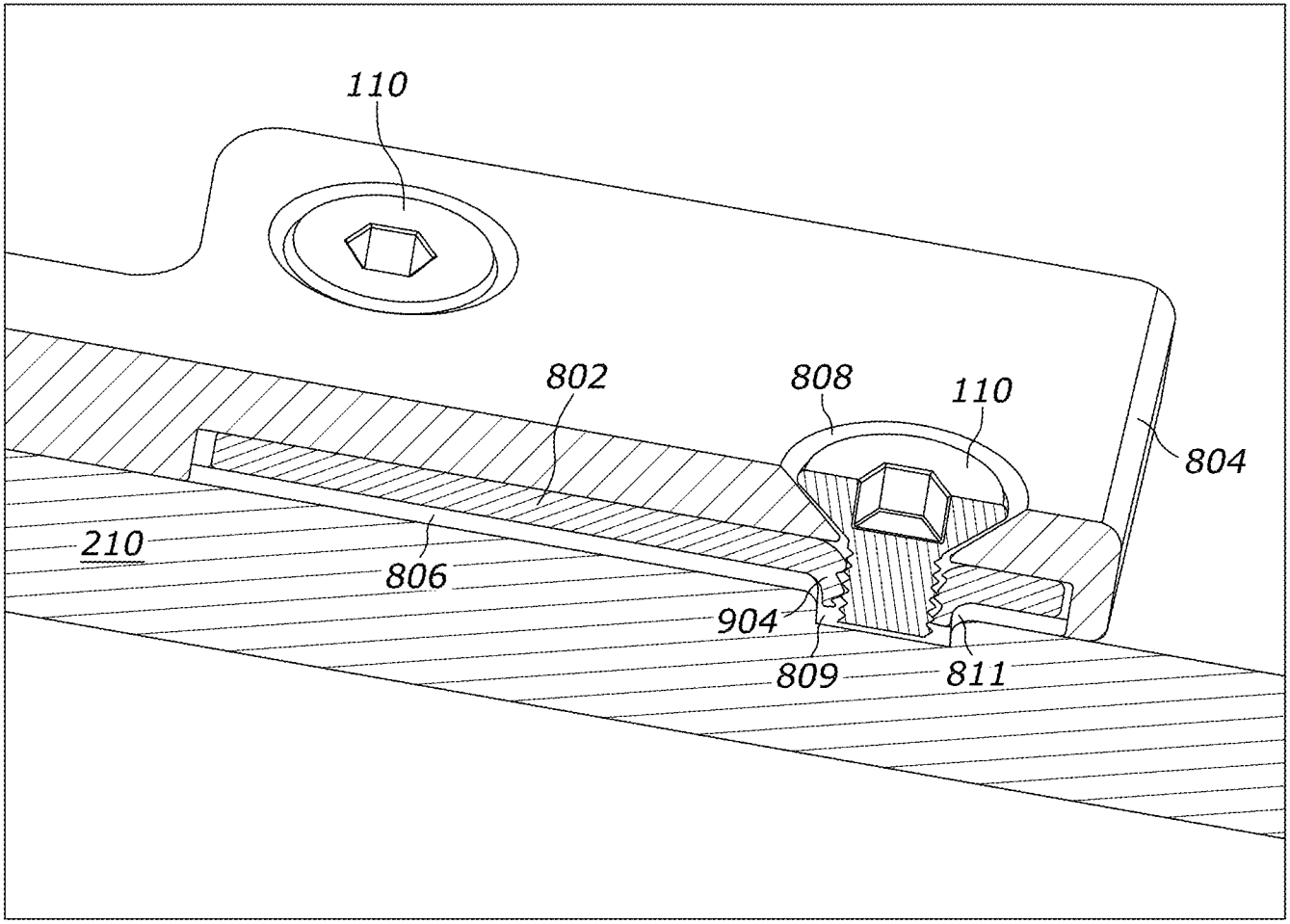

FIGS. 8 and 9 illustrate another example hinge assembly 800 according to embodiments of the present disclosure. In particular, FIG. 8 shows an exploded view of the hinge assembly 800, and FIG. 9 shows an assembled cross-sectional view of the hinge assembly 800. The hinge assembly 800 includes multiple components that are the same as, or similar to, corresponding components of the hinge assembly 108. However, the hinge assembly 800 is configured to be attached to the toilet lid or toilet seat without the need for a recess in the lid/seat, such as the recess 406.

As shown in FIGS. 8 and 9, the toilet lid 102 is formed with a core structural layer 200 and a second layer 210. In some embodiments, the core structural layer 200 is formed of sintered stone, and the second layer 210 is formed of metal. The hinge assembly 800 includes a hinge portion 801 and a hinge connection plate 802. The hinge portion 801 includes a flat portion 804 with a back surface that includes a recess area, as shown in FIG. 9.

The hinge connection plate 802 is secured to the second layer 210 with an adhesive layer 806. The adhesive layer 806 can be, for example, a VHB glue by 3M. In some embodiments, the adhesive layer 806 is approximately 0.8 mm in thickness. In other embodiments, the adhesive layer 806 can be a structural adhesive, such as methyl methacrylate or the like. Other adhesives having other thicknesses are possible and within the scope of this disclosure.

The flat portion 804, the second layer 210, the hinge connection plate 802, and the adhesive layer 806 all have corresponding fastener holes 808-811 that are positioned to align with each other when the components of the hinge assembly 800 are assembled. That is, the fastener holes 808 of the flat portion 804 align with corresponding fastener holes 809 of the second layer 210, with corresponding fastener holes 810 of the hinge connection plate 802, and also with corresponding fastener holes 811 of the adhesive layer 806. The alignment of the fastener holes 808-811 allows the fasteners 110 to be placed through the flat portion 804, the hinge connection plate 802, the adhesive layer 806, and into the second layer 210 for assembling the various components and securing the components together. While FIGS. 8 and 9 show three of each of the fastener holes 808-811, this is merely one example; the fastener holes 808-811 could be in other quantities and be arranged in other patterns.

As shown in FIG. 9, the fastener holes 810 of the hinge connection plate 802 each include a protrusion 904, similar to the protrusion 504 of the fastener hole 410. In the hinge assembly 800, the protrusion 904 projects downward, such that when the hinge assembly 800 is assembled, the protrusion 904 extends through the fastener hole 811 and into the fastener hole 809. In some embodiments, the inside surface of each fastener hole 810, including the inside surface of the protrusion 904, can include screw threads to accept a screw (i.e., the fastener 110) through the fastener hole 810.

Although FIGS. 8 and 9 depict various details of one example of a hinge assembly 800, various changes may be made to FIGS. 8 and 9. For example, while shown comprised of certain components, the hinge assembly 800 may include more or fewer components. Components shown in FIGS. 8 and 9 may be removed, repeated, or arranged in a different order. Components may have dimensions other than those shown or described. Other components, composed of the same or different materials, may be added to the hinge assembly 800.

Figure 10:
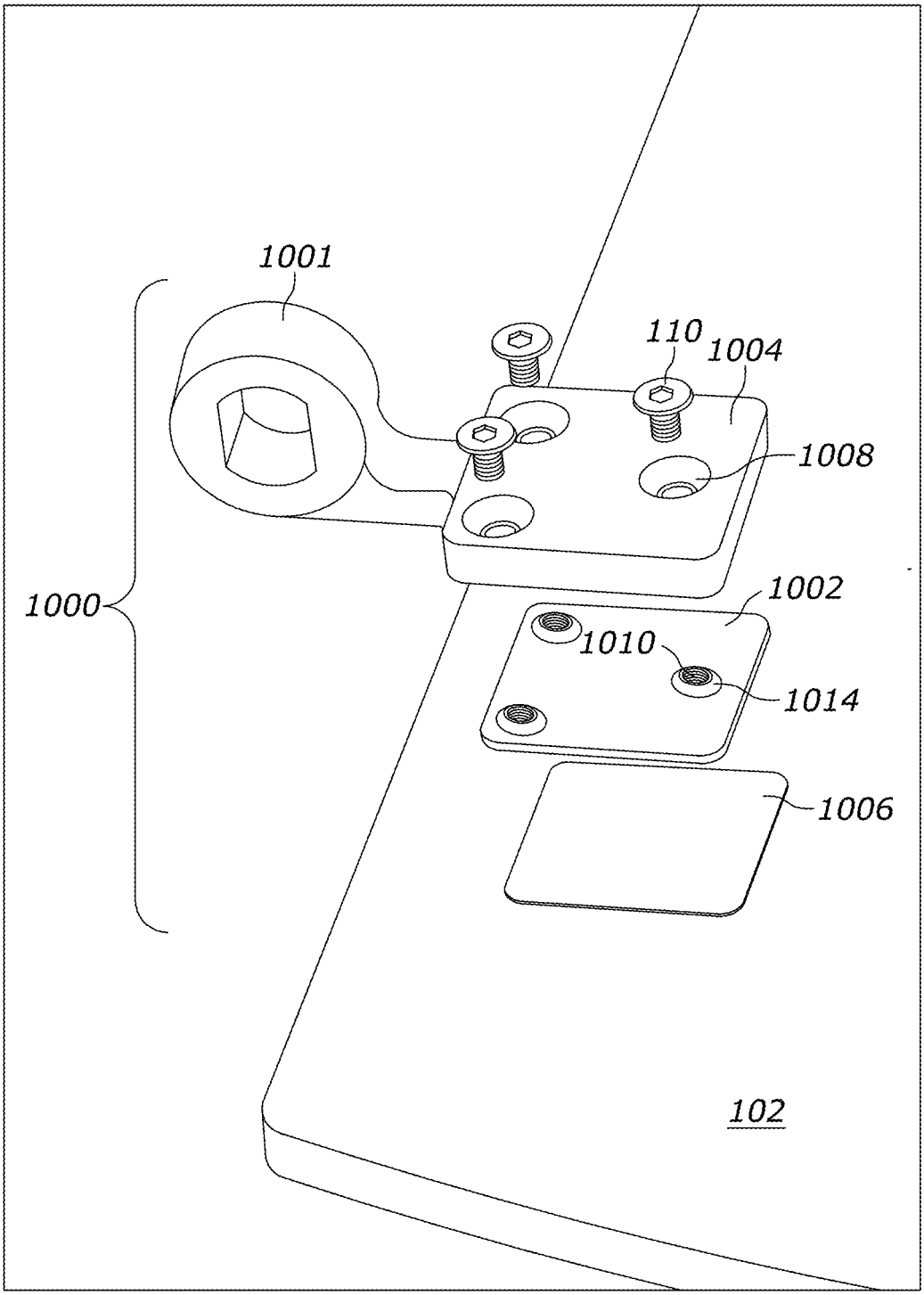
FIGS. 10 and 11 illustrate another yet example hinge assembly according to embodiments of the present disclosure.
Figure 11:
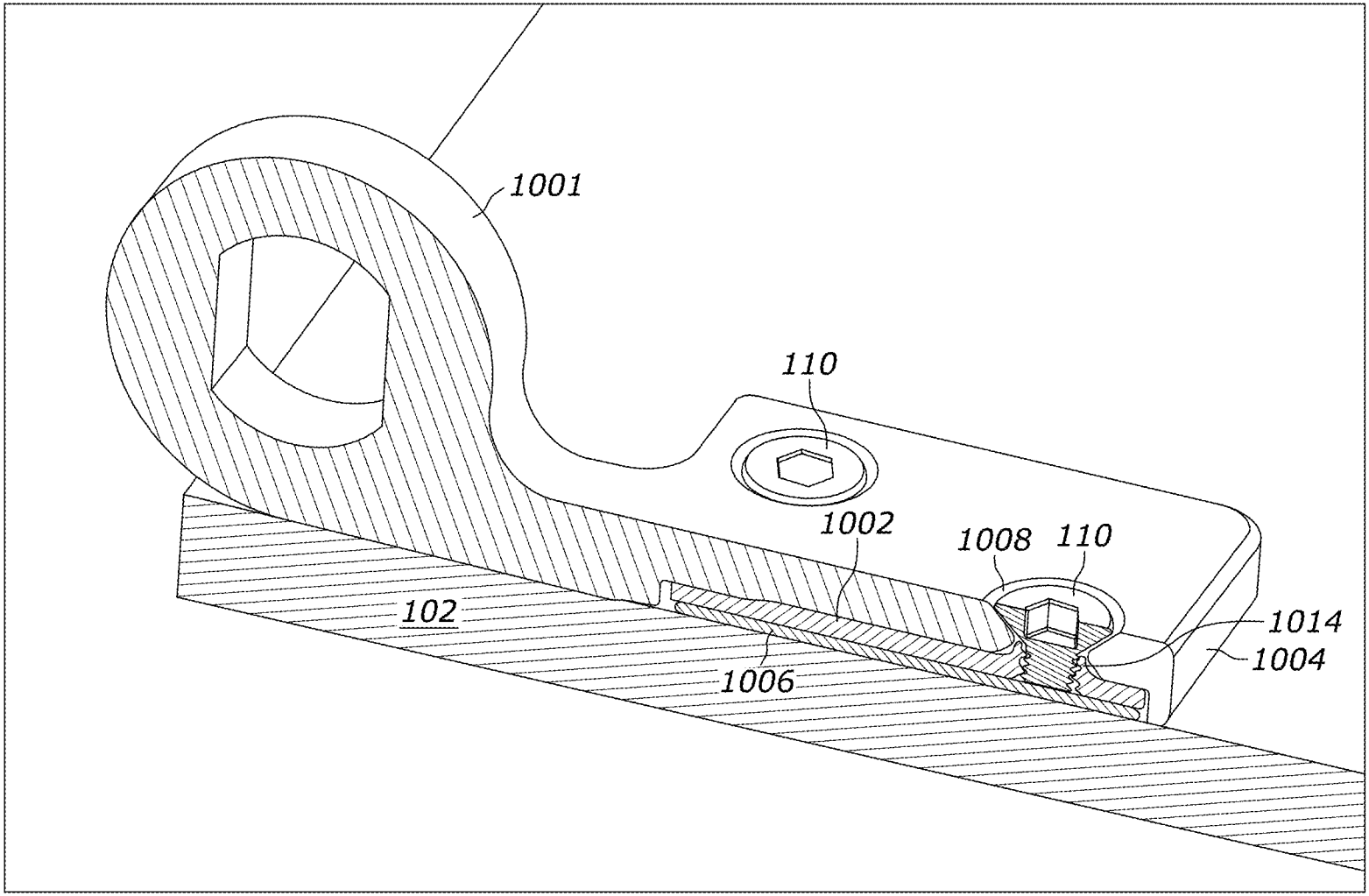

FIGS. 10 and 11 illustrate another example hinge assembly 1000 according to embodiments of the present disclosure. In particular, FIG. 10 shows an exploded view of the hinge assembly 1000, and FIG. 11 shows an assembled cross-sectional view of the hinge assembly 1000. The hinge assembly 1000 includes multiple components that are the same as, or similar to, corresponding components of the hinge assembly 800.

As shown in FIGS. 10 and 11, the hinge assembly 1000 includes a hinge portion 1001 and a hinge connection plate 1002. The hinge portion 1001 includes a flat portion 1004 with a back surface that includes a recess area, as shown in FIG. 11. The hinge connection plate 1002 is secured to the toilet lid 102 with an adhesive layer 1006. The adhesive layer 1006 can be, for example, structural adhesive, such as methyl methacrylate or the like. In some embodiments, the adhesive layer 1006 is approximately 0.8 mm in thickness. Other adhesives having other thicknesses are possible and within the scope of this disclosure.

The flat portion 1004 and the hinge connection plate 1002 each have corresponding fastener holes 1008 and 1010 that are positioned to align with each other when the components of the hinge assembly 1000 are assembled. That is, the fastener holes 1008 of the flat portion 1004 align with corresponding fastener holes 1010 of the hinge connection plate 1002. The alignment of the fastener holes 1008 and 1010 allows the fasteners 110 to be placed through the flat portion 1004 and the hinge connection plate 1002 for assembling the various components and securing the components together. While FIGS. 10 and 11 show three of each of the fastener holes 1008 and 1010, this is merely one example; the fastener holes 1008 and 1010 could be in other quantities and be arranged in other patterns.

As shown in FIGS. 10 and 11, the fastener holes 1010 of the hinge connection plate 1002 each include a protrusion 1014, similar to the protrusion 904 of the fastener hole 810. Unlike in the hinge assembly 800, where the protrusions 904 project downward, in the hinge assembly 1000, the protrusions 1014 project upward, such that when the hinge assembly 1000 is assembled, the protrusions 1014 extend into the corresponding fastener holes 1008. This arrangement allows no recesses or fastener holes to be formed in the toilet lid 102. In some embodiments, the inside surface of each fastener hole 1010, including the inside surface of the protrusion 1014, can include screw threads to accept a screw (i.e., the fastener 110) through the fastener hole 1010.

Although FIGS. 10 and 11 depict various details of one example of a hinge assembly 1000, various changes may be made to FIGS. 10 and 11. For example, while shown comprised of certain components, the hinge assembly 1000 may include more or fewer components. Components shown in FIGS. 10 and 11 may be removed, repeated, or arranged in a different order. Components may have dimensions other than those shown or described. Other components, composed of the same or different materials, may be added to the hinge assembly 1000.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle. Use of any other term, including without limitation "mechanism," "module," "device," "unit," "component," "element," "member," "apparatus," "machine," "system," "processor," or "controller," within a claim is understood by the applicants to refer to structures known to those skilled in the relevant art and is not intended to invoke 35 U.S.C. § 112(f).

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A system comprising:

a toilet seat;

a toilet lid comprising a core structural layer and a second layer; and at least one hinge assembly pivotally coupling the toilet seat and toilet lid, each of the at least one hinge assembly comprising:

a hinge portion in contact with an exterior surface of the second layer; and a hinge connection plate in contact with an interior surface of the second layer, the hinge connection plate having multiple first fastener holes extending completely through the hinge connection plate, each first fastener hole having a protrusion.

2. A system comprising:

a toilet seat;

a toilet lid comprising a core structural layer and a second layer; and at least one hinge assembly pivotally coupling the toilet seat and toilet lid, each of the at least one hinge assembly comprising:

a hinge portion in contact with an exterior surface of the second layer; and a hinge connection plate in contact with an interior surface of the second layer, the hinge connection plate having multiple first fastener holes extending completely through the hinge connection plate, each first fastener hole having a protrusion, wherein:

the core structural layer comprises a recess; and the hinge connection plate is disposed within the recess.

3. The system of claim 2, wherein the recess has a shape and a size corresponding to a shape and a size of the hinge connection plate.

4. The system of claim 1, wherein:

the hinge portion comprises multiple second fastener holes, each second fastener hole aligning with one of the first fastener holes; and the second layer comprises multiple third fastener holes, each third fastener hole aligning with one of the first fastener holes and one of the second fastener holes.

5. The system of claim 4, wherein the protrusion of each first fastener hole is disposed within the aligned third fastener hole.

6. The system of claim 4, further comprising:

multiple fasteners, each fastener extending through one of the first fastener holes, one of the second fastener holes, and one of the third fastener holes.

7. The system of claim 6, wherein each fastener is a screw and each first fastener hole comprises screw threads configured to accept the screw.

8. The system of claim 1, wherein the core structural layer comprises sintered stone.

9. The system of claim 1, wherein the second layer is formed of metal.

10. The system of claim 1, wherein the second layer is formed of at least one of fiber reinforced cement board or fiber reinforced calcium silicate board.

11. A toilet seat assembly comprising:

a toilet seat;

a toilet lid comprising a core structural layer and a second layer; and multiple hinge assemblies pivotally coupling the toilet seat and toilet lid, each hinge assembly comprising:

a hinge portion having a flat surface in contact with an exterior surface of the second layer;

a hinge connection plate in contact with an interior surface of the second layer, the hinge connection plate having multiple first fastener holes, each first fastener hole having a protrusion; and multiple fasteners connecting the hinge portion and the hinge connection plate, wherein the core structural layer comprises a recess.

12. The toilet seat assembly of claim 11, wherein:

the hinge connection plate is disposed within the recess.

13. The toilet seat assembly of claim 12, wherein the recess has a shape and a size corresponding to a shape and a size of the hinge connection plate.

14. The toilet seat assembly of claim 11, wherein:

the hinge portion comprises multiple second fastener holes, each second fastener hole aligning with one of the first fastener holes; and the second layer comprises multiple third fastener holes, each third fastener hole aligning with one of the first fastener holes and one of the second fastener holes.

15. The toilet seat assembly of claim 14, wherein the protrusion of each first fastener hole is disposed within the aligned third fastener hole.

16. The toilet seat assembly of claim 14, wherein each of the multiple fasteners extends through one of the first fastener holes, one of the second fastener holes, and one of the third fastener holes.

17. The toilet seat assembly of claim 16, wherein each fastener is a screw and each first fastener hole comprises screw threads configured to accept the screw.

18. The toilet seat assembly of claim 11, wherein the core structural layer comprises sintered stone.

19. The toilet seat assembly of claim 11, wherein the second layer is formed of metal.

20. The toilet seat assembly of claim 11, wherein the second layer is formed of at least one of fiber reinforced cement board or fiber reinforced calcium silicate board.

* * * * *